US005248122A

United States Patent [19]

Graham

[11] Patent Number: 5,248,122

[45] Date of Patent: Sep. 28, 1993

[54] PRE-ATTACHED FORM SYSTEM FOR INSULATED CONCRETE WALL PANEL

[76] Inventor: Tom S. Graham, 1226 E. 19th, Tulsa, Okla. 74120

[21] Appl. No.: 594,289

[22] Filed: Oct. 9, 1990

Related U.S. Application Data

[63] Continuation-in-part of Ser. No. 369,959, Jun. 22, 1989, abandoned.

[51] Int. Cl.[5] ..... B22D 5/00

[52] U.S. Cl. ..... 249/91; 264/35; 52/656.8; 52/365; 52/309.12; 52/309.16

[58] Field of Search ..... 52/125.4, 125.5, 309.11, 52/309.12, 405, 406, 600, 601, 656, 365, 309.12, 309.16, 309.17; 249/91; 264/35; 425/117

[56] References Cited

U.S. PATENT DOCUMENTS

| | | | |
|---|---|---|---|
| 2,081,499 | 5/1937 | Nagel | 52/601 X |
| 2,178,097 | 10/1939 | Davidson et al. | 52/601 X |
| 2,664,740 | 1/1954 | Cochrane | 52/281 X |
| 3,228,161 | 1/1966 | McCown | 52/601 X |
| 3,545,214 | 12/1970 | Grazel | 52/601 X |
| 3,604,174 | 9/1971 | Nelson, Jr. | 52/601 |
| 3,760,540 | 9/1973 | Latoria et al. | 52/601 X |
| 3,879,908 | 4/1975 | Weismann | 52/600 X |
| 3,881,289 | 5/1975 | Mauroner | 52/600 X |
| 4,037,381 | 7/1977 | Charles | 52/601 X |
| 4,320,606 | 3/1982 | Ganga Ras | 52/600 X |
| 4,454,702 | 6/1984 | Bonilla-Lugo et al. | 52/745 |
| 4,472,919 | 9/1984 | Nourse | 52/601 |
| 4,489,530 | 12/1984 | Chang | 52/309.12 X |
| 4,541,211 | 9/1985 | Garrett | 52/309.12 X |
| 4,574,550 | 3/1986 | Maschhoff | 52/309.12 X |
| 4,635,414 | 1/1987 | Allen | 52/126.1 |
| 4,649,682 | 3/1987 | Barrett, Jr. | 52/601 X |
| 4,702,053 | 10/1987 | Hibbard | 52/309.12 X |
| 5,033,248 | 7/1991 | Phillips | 52/747 X |
| 5,038,541 | 8/1991 | Gibbar, Jr. | 52/309.12 X |

FOREIGN PATENT DOCUMENTS

| | | | |
|---|---|---|---|
| 430064 | 2/1948 | Italy | 52/600 |

*Primary Examiner*—Carl D. Friedman
*Assistant Examiner*—Lan M. Mai
*Attorney, Agent, or Firm*—Catalano, Zingerman & McKay

[57] ABSTRACT

An insulated structural wall panel includes a monolithic concrete shell poured to conform to a structural reinforcing grid embedded in the shell with insulation panels fixed within the grid spaces. The layers of concrete which sandwich the insulation panels are rigidly tied together by use of tie rods extending through the insulation panel. This monolithic construction results in a lightweight panel with superior structural qualities, the concrete, the reinforcing grid and the insulation panels having been blended together into one homogeneous member. The panel may incorporate extraneous assemblies including doors, windows, vents, pipes, electrical junction boxes and the like. The reinforcing grid may also include various adaptive devices for suitable attachment of the concrete wall panel to concrete footings, floor slabs, roof members, temporary supports and the like.

14 Claims, 4 Drawing Sheets

PRE-ATTACHED FORM SYSTEM FOR INSULATED CONCRETE WALL PANEL

CROSS-REFERENCE TO RELATED APPLICATIONS

This is a continuation-in-part of application Ser. No. 07/369,959, filed Jun. 22, 1989, now abandoned.

BACKGROUND OF THE INVENTION

This invention relates to structural wall systems employed in the construction of commercial and industrial buildings and more particularly concerns on-site construction of concrete wall panels incorporating insulating materials in the panel.

The basic principle of incorporating an insulating material between two layers of concrete is not unique to the construction industry. However, efforts to utilize this principle in a practical wall system with sufficient flexibility to encompass a wide range of commercial and industrial applications have met with limited success. The insulated concrete wall panel systems currently marketed are generally inadequate due to deficient insulating properties, excessive bulk and weight characteristics, structural complexity or a combination of these design inadequacies.

They consist basically of two structurally independent concrete panels with a layer of insulation material between them in order to achieve both structural and insulation properties. In this arrangement, the addition of a second layer of concrete, insulation material, steel reinforcing materials and the connectors necessary for lamination to the primary layer of concrete produce a heavy and difficult to handle panel. Panels of this type often weigh in excess of 100 pounds per square foot of panel area. The mechanical connection of two heavy, independent concrete panels with an insulation layer between them presents structural problems which are difficult to overcome. Furthermore, the insulation thickness which can be incorporated between the concrete layers without compounding the structural problems is limited.

Other disadvantages result because the insulation material in these systems generally covers the entire area of the "primary" panel, leaving the edges of the insulation material exposed in the finished product. This allows penetration of moisture between the two layers of concrete causing corrosion in the laminating tie system, decay of the insulation material, loss of insulation properties and eventual structural problems.

A variation of this multi-panel, laminate design substitutes a concrete "grid" or "waffle" pattern slab on top of a self-sufficient primary panel with insulation panels occurring within the concrete grid. This variation eliminates the problem of exposed insulation edges and structural bonding problems between the separate concrete panels, but the overall panel weight is extremely high. Therefore, as with the previously described panel configuration, this inefficient design results in high cost and a cumbersome product to handle, transport and erect.

Despite the fact that these panels are heavy and cumbersome, the normal procedure is to construct them in an off-site facility and then transport them to the job-site for erection. They could be constructed on-site but additional problems of control are added to those of design, resulting in a finished product of haphazard quality and undependable structural capability. Furthermore, the entire building project is delayed until all the wall panels have been formed and poured on the building floor slab and allowed to "cure" for a period of perhaps ten to twenty days. This period of project "shutdown" during fabrication of the wall panels can consume from six weeks to three months, depending upon the scope of the project.

In another variation directed at these on-site problems, wall panels utilizing the laminate principle have been constructed on the job-site in a vertical position directly over the footing system. But this requires highly labor intensive form systems and an on-site assembled steel reinforcing structure. Of all presently used insulated wall systems, this is the most labor intensive, time consuming and expensive. Walls of this type are "custom built" without any of the benefits of production techniques and systems. It is also difficult to place concrete into the formed wall system without dislodging the insulation material occurring at the central point of the wall.

It is therefore an object of this invention to facilitate a versatile concrete wall panel system utilizing the compositelaminate principle that is capable of supporting structural loads commonly encountered in commercial and industrial buildings, but which can be readily produced in volume at a competitive cost. Another object of this invention facilitates construction of a concrete wall panel system which combines both structural and insulating functions in a single, monolithic system without duplication of function. Similarly, it is an object of this invention to facilitate construction of a concrete wall panel system which completely surrounds the insulation components in the reinforced monolithic, concrete body of the panel, providing both the structural requirements and protective facing for the insulation material in a strong, lightweight product.

Moreover, it is an object of this invention to provide a preattached form system for a concrete wall panel in which the form members which define the perimeter of the panel are rigidly connected to the panel reinforcing members. And it is a further object of this invention to provide a pre-attached form system which permit the rigid connection thereto of any insulation supports, lifting anchors, weld plates and other accessories in condition ready for the addition of insulation panels and concrete material either on or off-site.

One advantage of this invention is to reduce on-site panel construction time to approximately two to three days. The light weight of a panel formed by this system allows manipulation of the panel with a significantly smaller mobile crane than would otherwise be required.

Greater accuracy in forming is achieved, resulting in superior dimensional tolerances for the panel. This also results in a reduction in the erection time required. A higher panel quality is achieved, with known structural and insulation characteristics. Accurate panel dimensions and location of weld plates and other accessories is assured. It is not necessary to rigidly attach forming members to the floor slab of the building, eliminating the need to install and remove fasteners and patch the resulting holes. Panels can be easily "stack-cast" if sufficient, unobstructed floor space is not available. In this process, one panel is poured directly on top of another. Stacking of panels of conventional job-cast design results in substantially higher forming costs. The job-site labor force is significantly reduced. The pre-fabricated perimeter form design could also be readily used in a remote site operation, eliminating the need for expensive steel form beds and concrete placement equipment.

SUMMARY OF THE INVENTION

In accordance with the invention, a pre-attached form system for an insulated structural wall panel is provided into which concrete may be poured to conform to a structural reinforcing grid to which the form is attached, the concrete to surround insulation panels placed within the grid spaces. The pre-attached form may incorporate extraneous assemblies including doors, windows, vents, pipes, electrical junction boxes, various adaptive devices for suitable attachment of the concrete wall panel to concrete footings, floor slabs, roof members, temporary supports and the like which are fixed to the reinforcing grid.

BRIEF DESCRIPTION OF THE DRAWINGS

Other objects and advantages of the invention will become apparent from reading the following detailed description and upon reference to the drawings in which.

DETAILED DESCRIPTION

Turning to the Figures, a completed wall panel 10 is illustrated which consists of a structural reinforcing grid 30 framing in a number of insulation panel assemblies 60, all surrounded by a monolithic concrete casing 90.

Figure 1:
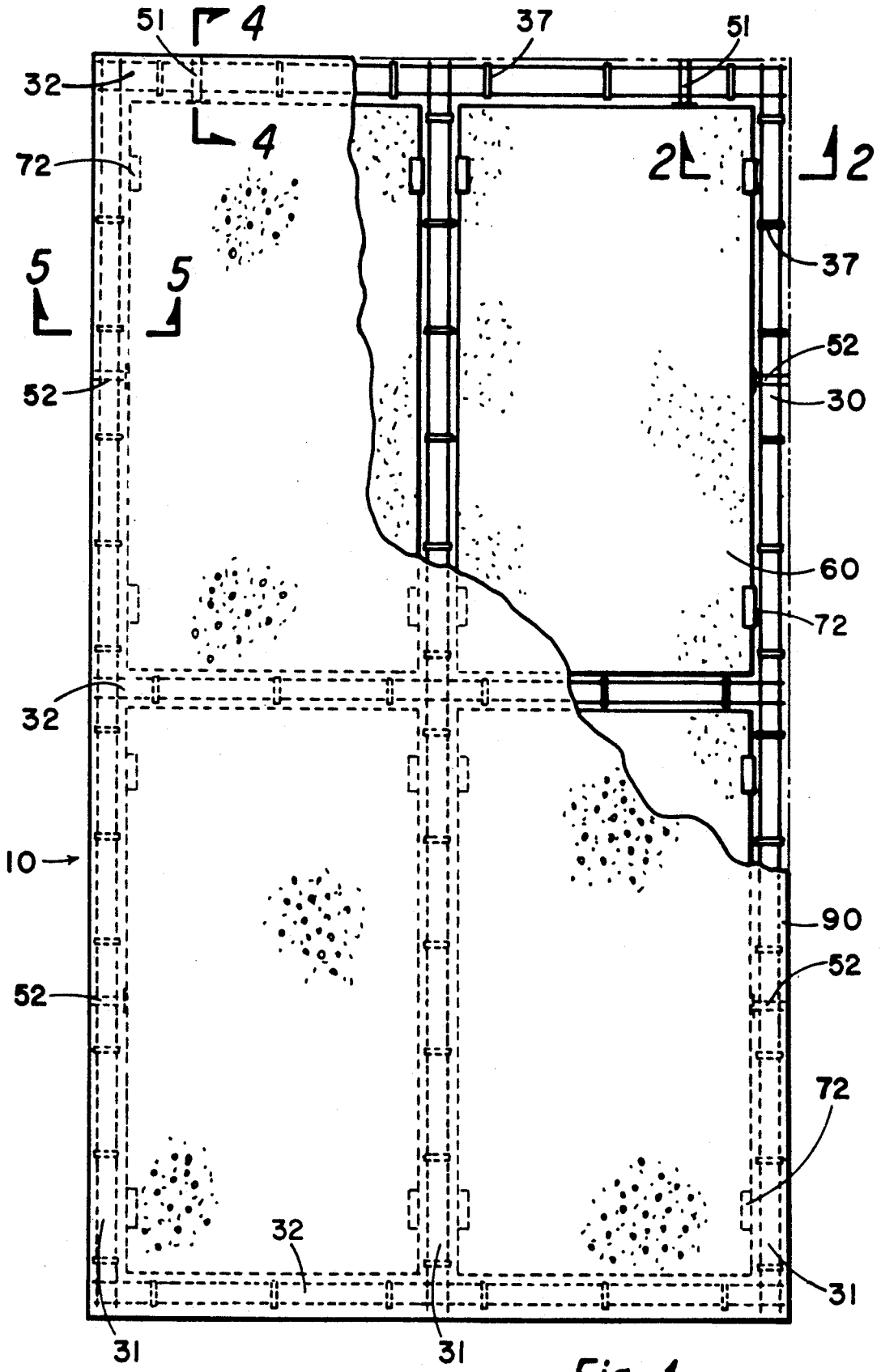
FIG. 1 is a plan with parts broken away illustrating the reinforcing grid and the insulation panel in the concrete panel.
Figure 2:
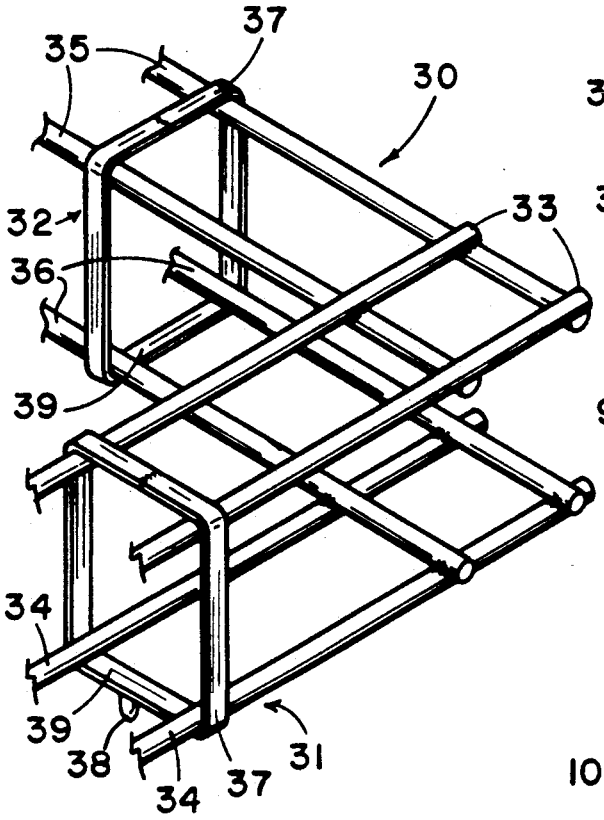
FIG. 2 is a perspective view taken at line 2—2 in FIG. 1 illustrating the assembly of the reinforcing grid.

The grid 30 is typically made using welded steel construction methods and consists of conventional steel reinforcing bars of a weldable type held in place by specialized bar ties. In the preferred embodiment shown in FIGS. 1 and 2, the reinforcing grid 30 uses at least two vertical members 31 and at least three horizontal members 32 which are generally equally spaced apart. The vertical members 31 are typically not more than five feet on center and the horizontal members 32 typically not more than eight feet on center, but this can vary depending on the panel load requirements or as inclusion in the reinforcing grid 30 of extraneous assemblies such as doors, windows, vents and the like (not shown) may dictate. As best seen in FIG. 2, each of the vertical 31 and horizontal members 32 consists of four steel rods 33 and 34 and 35 and 36 welded in a rectangular and parallel spaced apart relationship to several bar ties or rectangular steel straps 37. The reinforcing rods 33, 34, 35 and 36 are of the weldable type and in a deformed configuration. The straps 37 are typically constructed of 3/16 inch by ½ inch weldable steel bars and spaced approximately 16 to 24 inches on center, although specific applications may result in variations of these dimensions. One inch or ¾ inch strips of 12 gauge material have been found to be satisfactory. In addition to being welded to the straps 37, every upper face vertical rod 33 is welded to every upper face horizontal rod 35 and every lower face vertical rod 34 is welded to every lower face horizontal rod 36. Thus, all joints between the bar ties 37 and the reinforcing rods 33, 34, 35 and 36 and between intersecting rods 33 and 35 or 34 and 36 are welded together to form a rigid, monolithic, reinforcing system which can be incorporated into the concrete panel as a single component. This interlocking by welding provides a resultant reinforcing grid that displays a rigidity and stability not normally associated with other structures used to reinforce concrete panels. Furthermore, the welded reinforcing grid makes possible a highly efficient panel system by allowing the engineer greater degrees of control over grid member location and resultant panel weight.

Support members, such as machined steel rods 38, are also welded to the lower faces 39 of the steel straps 37 so as to position the grid 30 at the proper elevation within the panel forming system as is hereinafter explained.

Figure 3:
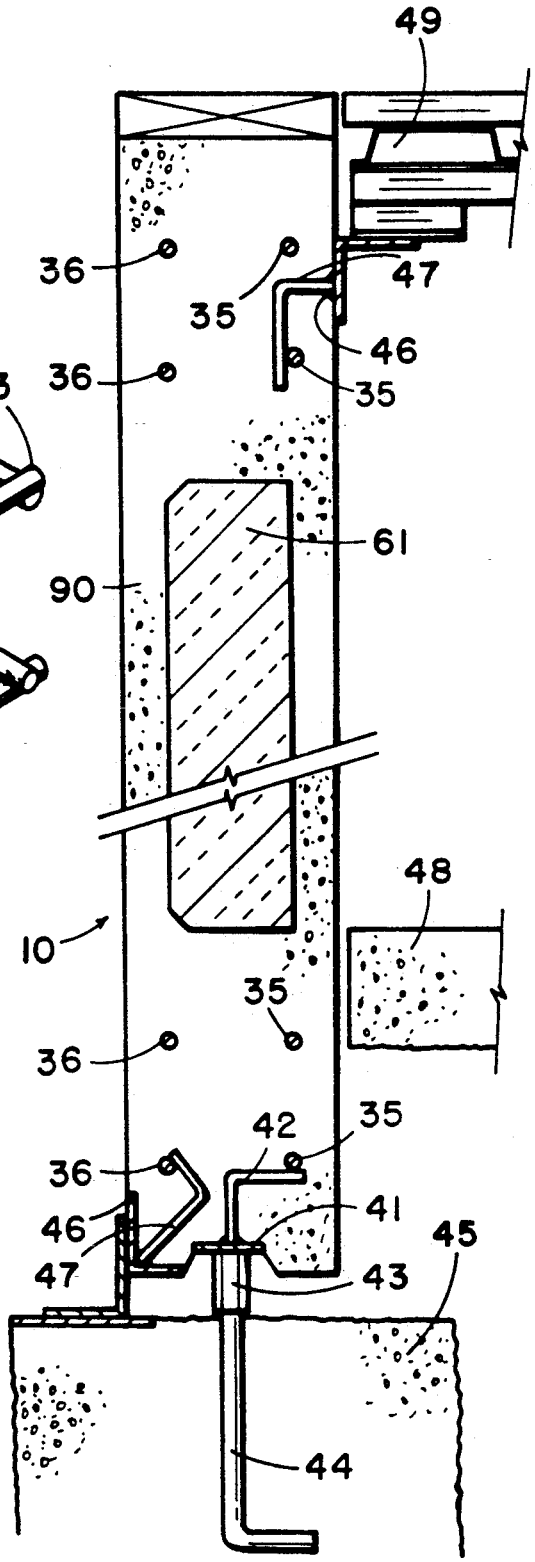
FIG. 3 is a cross section illustrating typical adaptive devices embedded or mounted in the upper or lower portions of the concrete panel in its mounted position in a building structure for connecting the building structure and the wall panel.

Various adaptive devices for connection of the concrete panel 10 to a building structure may also be fixed to the reinforcing grid as shown in FIG. 3. Steel bearing plates 41 attached to a welded steel anchor 42 which is in turn welded to the grid may be embedded in the concrete along the bottom surface of the concrete panel 10. When the finished concrete panel 10 is in the mounted position, the bearing plates 41 would each rest on a level adjuster such as a nut 43 threadedly mounted on a bolt 44 anchored in the concrete footing 45. Steel angle irons 46, or other suitable steel members, attached to a steel anchor 47 which is then attached to the grid may also be embedded or mounted on the surface along the top or bottom portion of the concrete panel to provide means for connecting the concrete panel 10 with the building footing 45, floor slab 48, roof structure 49, or the like.

Depending on the requirements of any particular project, additional adaptive members may be embedded in the concrete panel by use of connecting steel anchor rods fixed to the grid as necessary. All of these adaptive devices may be held in place for embedding in the concrete by welding the anchors to the grid 30.

Figure 4:
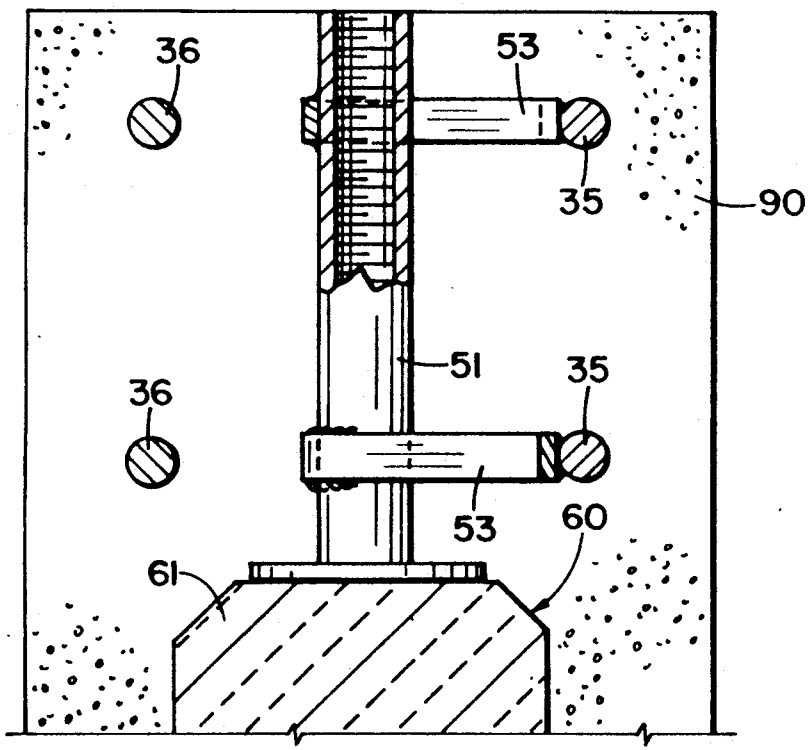
FIG. 4 is an enlarged cross section taken along line 4—4 of FIG. 1 illustrating the lift sleeves of the concrete wall panel.

Top and side lift sleeves 51 and 52 may also be provided for handling the completed concrete panel 10, the former for handling the concrete panel 10 in a vertical position and the latter for handling it in a horizontal position. The top lift sleeves 51 may, for example, be internally threaded steel sleeves, as shown in FIG. 4, fixed to anchors 53 embedded in the concrete. The sleeves 51 are spaced apart in the top surface of the concrete panel 10 with the threaded portion being accessible from the top of the concrete panel 10. The side lift sleeves 52 consist of two pairs of sleeves, not necessarily threaded, each pair being disposed on opposite sides of the concrete panel 10 with the sleeves 52 being accessible from the side of the concrete panel 10. The sleeves 52 are spaced apart in the sides of the concrete panel 10 such that the weight of the concrete panel 10 will be substantially evenly distributed during lift in the horizontal position. The sleeves 52 may be mounted in the concrete panel 10 by use of anchor rods 53 welded to the grid 30.

Figure 5:
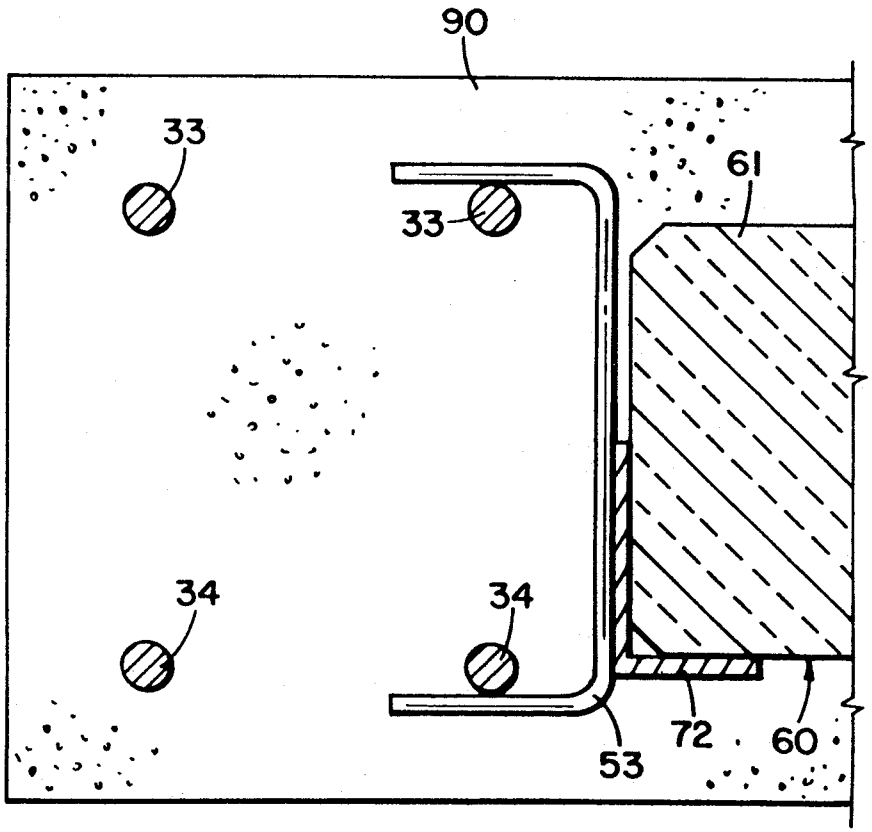
FIG. 5 is an enlarged cross section taken along line 5—5 of FIG. 1 illustrating the connection of the insulation panel to the reinforcing grid.

As shown in FIG. 5, the grid 30 can also include provisions for the connection of the insulation panel assemblies 60 to the grid 30, perhaps by use of C-brackets 53 welded to the reinforcing rods 33 and 34. The connection of the insulation panel assemblies 60 to the brackets 53 will be hereinafter explained.

The insulation panel 61 is selected according to the specific insulating, fire resistance and weight characteristics required of the concrete panel 10. Any material of sufficient rigidity and stiffness to withstand the stresses of assembly and production may be used including foamed plastics, fiberglass, rock wool, mineral wool, foam glass, insulating concretes and numerous other alternatives.

Figure 6:
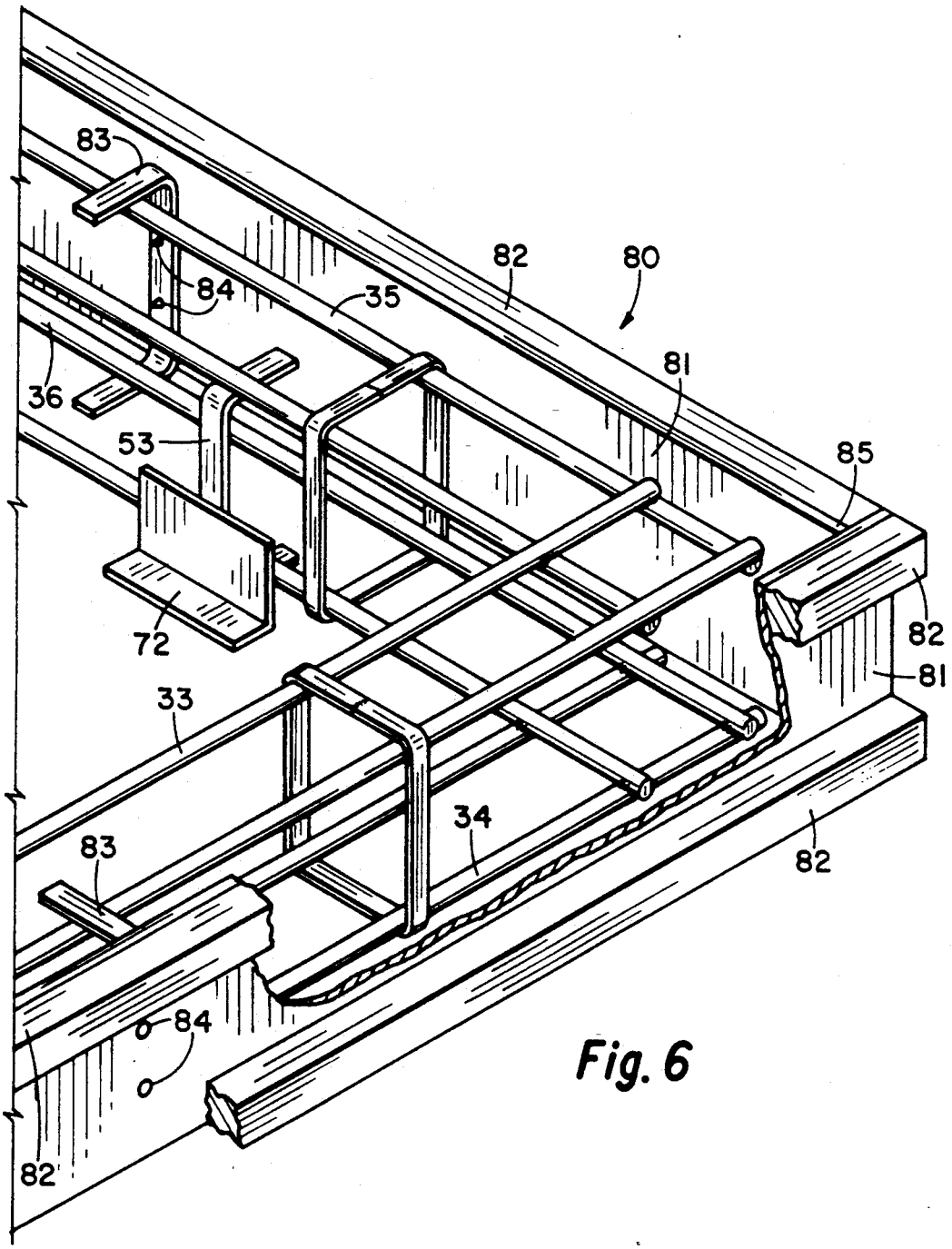
FIG. 6 is a perspective view illustrating the pre-attached forms mounted on the reinforcing grid.

The pre-attached form system including the reinforcing grid is illustrated in FIG. 6. The form system 80 as shown consists of plywood facing panels 8, perhaps ¾" thick having a depth equal to the thickness of the wall section to be formed. The facing panels 81 are cut at least to the length and width of the wall section and rigidity of the facing panels 81 may be assured by use of reinforcing braces such as wood flanges 82 which may be screwed or otherwise secured lengthwise to the facing panels 81. C-brackets 83 are secured at intervals along the outer reinforcing rods 33 and 34 of the outer columns 31 of the wall section and along the outer reinforcing rods 35 and 36 of the beams 32 of the wall section. This is preferably accomplished by welding if steel rods and brackets are used. The back faces of the brackets 83 will be set in the planes of the edges of the wall section to be formed. The facing panels 81 may thus be secured to the brackets 83, or by screws 84, with the ends of the facing panels in abutment at the corners 85 of the form 80 as shown.

Once on the job site, the pre-attached form systems are unloaded with a light mobile crane and distributed over the building floor slab in a predetermined arrangement.

Sufficient concrete is poured within the panel forms 80 to produce a desired thickness or first layer of concrete, perhaps a 1.5" thick layer. This concrete is screeded to an accurate level, coinciding with the top face of the insulation brackets 72, which serve as a gauge for the required concrete thickness. Any excess concrete material is accumulated in the areas of the panel constituting the columns 31 and beams 32. Insulation panels 61 are then placed within the insulation brackets 72, on top of the first layer of concrete, and firmly pushed or walked into contact with the concrete. Connecting ties may be installed through pre-drilled holes in the insulation panels 61 creating a positive structural tie between concrete face wythes or may be pre-attached to the insulation panels 61. The balance of the concrete material is poured inside the perimeter panel forms 80 and screeded to a level even with the top edge of the forms 80. A surface finish is applied and concrete curing and removal of the perimeter forms is accomplished in a similar fashion to that associated with conventional job-cast panels.

Many variations are of course possible. Insulating panel thickness can be varied to achieve the desired panel insulation properties. The concrete panels may be virtually any height or width and with varying structural capabilities. This can be accomplished by varying the size of the reinforcing bars or the thickness of the concrete panels or by use of additional steel reinforcing bars or any combination of these and other variations. The steel rods 33, 34, 35 and 36 may be fixed to truss bars or various combinations of tie arrangements other than bar ties or rectangular straps. Structural reinforcing mats or bars may be embedded in the concrete panel layers. The variety of finishes which can be applied to either face of the panel is also virtually unlimited and may include exposed aggregate finishes, smooth formed faces, formed embossed finishes, hand broomed or raked finishes, impressed finishes, tile or brick, stucco plaster, polymer concrete grout and any of numerous other variations of these specific finishes.

Furthermore, while the concrete panel has been described in relation to a welded steel embodiment, the principles involved may equally well apply to the use of fiberglass or other structural materials chemically mastecized or glued together, or to angle iron, I-bar, trusses or other types of reinforcing members and it is also contemplated that the description applicable to wall panels includes roof panels as well.

Thus, while the invention has been described in connection with a preferred embodiment and procedure, it will be understood that it is not intended to limit the invention to that embodiment or procedure. On the contrary, it is intended to cover all alternatives, modifications and equivalents as may be included within the spirit and scope of the invention as defined by the appended claims.

What is claimed is:

1. A pre-attached form system for making a structural wall panel comprising:

a rigid structural reinforcing grid consisting of at least two vertical members approximately equally spaced apart and at least three horizontal members approximately equally spaced apart, each of said members consisting of a plurality of rods and means fixing said rods in parallel spaced apart relationship, every vertical rod being fixed to at least one rod of each of said horizontal members and every horizontal rod being fixed to at least one rod of each of said vertical members;

a plurality of bracket means, at least two spaced along the length of and fixed to each of the outermost of said vertical and horizontal members, each said bracket means having a planar surface coincident with the planar surface of an edge of the wall panel to be made which corresponds to the member to which said bracket means is attached; and a plurality of facing members having a width equal to the thickness of the wall panel to be made, each one of said facing members being detachably fixed against said planar surfaces of said bracket means lying in the same plane, said facing members having opposing edges defining parallel planar surfaces of the wall panel to be made with said grid therebetween.

2. The system according to claim 1, said vertical and horizontal members defining a plurality of spaces therebetween into at least one of which an insulation panel may be inserted, said system further comprising:

a second plurality of bracket means, at least two spaced along the length of and fixed to each of opposing segments of either said vertical or said horizontal members defining a space into which an insulation panel is to be inserted; and a plurality of means, one fixed to each of said bracket means of said second plurality of bracket means, for supporting an insulation panel within its respective space between said vertical and horizontal members.

3. A pre-attached form system for making a structural wall panel comprising:

a rigid structural reinforcing grid consisting of at least two vertical members approximately equally spaced apart and at least three horizontal members approximately equally spaced apart, each of said members consisting of at least four rods and means for fixing said rods in parallel rectangular configuration, every vertical rod being fixed to two rods of each of said horizontal members and every horizontal rod being fixed to two rods of each of said vertical members;

a plurality of bracket means, at least two spaced along the length of and fixed to each of the two outermost rods of each of the outermost of said vertical and horizontal members, each said bracket means having a planar surface coincident with the planar surface of an edge of the wall panel to be made which corresponds to the member to which said bracket means is attached; and a plurality of facing members having a width equal to the thickness of the wall panel to be made, each one of said facing members being detachably fixed against said planar surfaces of said bracket means lying in the same plane, said facing members having opposing edges defining parallel planar surfaces of the wall panel to be made with said grid therebetween.

4. The system according to claim 3, said vertical and horizontal members defining a plurality of spaces therebetween into at least one of which an insulation panel may be inserted, said system further comprising:

a second plurality of bracket means, at least two spaced along the length of and fixed to each of opposing segments of the two innermost rods of either said vertical or said horizontal members defining a space into which an insulation panel is to be inserted; and a plurality of means, one fixed to each of said bracket means of said second plurality of bracket means, for supporting an insulation panel within its respective space between said vertical and horizontal members.

5. The system according to claim 4, said plurality of bracket means comprising a plurality of C-shaped brackets having arms fixed to their respective rods and backs coincident with their respective plane of the edge of the wall panels to be made.

6. The system according to claim 5, said second plurality of bracket means comprising a second plurality of C-shaped brackets having arms fixed to their respective rods and backs parallel to the edges of the insulation panel to be inserted therebetween.

7. A pre-attached form system for making a structural wall panel comprising:

a rigid structural reinforcing grid consisting of at least two vertical members approximately equally spaced apart and at least three horizontal members approximately equally spaced apart, each of said members consisting of a plurality of rods and means for fixing said rods in parallel rectangular configuration, every vertical rod being fixed to two rods of each of said horizontal members and every horizontal rod being fixed to two rods of each of said vertical members, said vertical and horizontal members defining a plurality of spaces therebetween into at least one of which an insulation panel may be inserted;

a first plurality of C-shaped brackets, at least two spaced along the length of and fixed to each of the two outermost rods of each of the outermost of said vertical and horizontal members, each of said brackets having arms fixed to their respective rods and backs coincident with their respective plane of the edge of the wall panels to be made;

a plurality of facing members having a width equal to the thickness of the wall panel to be made, each one of said facing members being detachably fixed against said backs of said first plurality of C-shaped brackets lying in the same plane, said facing members having opposing edges defining parallel planar surfaces of the wall panel to be made with said grid therebetween;

a second plurality of C-shaped brackets, at least two spaced along the length of each of opposing segments of the two innermost rods of either said vertical or said horizontal members defining a space into which an insulation panel is to be inserted and having arms fixed to their respective rods and backs parallel to the edges of the insulation panel to be inserted therebetween; and a plurality of L-shaped brackets having backs fixed to said backs of their respective C-shaped brackets and arms extending inwardly with respect to their respective spaces, one fixed to each of said second plurality of C-shaped brackets, for supporting an insulation panel within its respective space between said vertical and horizontal members.

8. The system according to claim 7 further comprising at least one pair of sleeves fixed to said grid, one sleeve fixed to either each outermost vertical or each outermost horizontal member of said grid and having an exterior end thereof coplanar with its respective edge of the wall panel to be made.

9. The system according to claim 7 further comprising a pair of inwardly threaded sleeves fixed in spaced apart relationship to the uppermost of said horizontal members, said sleeves having an exterior end of their threaded openings coplanar with their respective edge of the wall to be made.

10. The system according to claim 7 wherein the members of said grid are formed of weldable steel and all fixed joints of and between said members are formed by welding.

11. The system according to claim 10, each of said plurality of bracket means being welded to their respective vertical and horizontal members.

12. The system according to claim 10, each of said second plurality of bracket means being welded to their respective vertical or horizontal members.

13. The system according to claim 12, each of said plurality of supporting means being welded to their respective ones of said second plurality of bracket means.

14. A pre-attached form system for making a structural wall panel comprising:

a rigid structural reinforcing grid consisting of at least two vertical members approximately equally spaced apart and at least three horizontal members approximately equally spaced apart, each of said members consisting of a plurality of rods and means fixing said rods in parallel spaced apart relationship, every vertical rod being fixed to at least one rod of each of said horizontal members and every horizontal rod being fixed to at least one rod of each of said vertical members, said vertical and horizontal members defining a plurality of spaces therebetween into at least one of which an insulation panel may be inserted;

a plurality of bracket means, at least two spaced along the length of and fixed to each of the outermost of vertical and horizontal members, each said bracket means having a planar surface coincident with the planar surface of an edge of the wall panel to be made which corresponds to the member to which said bracket means is attached;

a plurality of facing members having a width equal to the thickness of the wall panel to be made, each one of said facing members being detachably fixed against said planar surfaces of said bracket means lying in the same plane, said facing members having opposing edges defining parallel planar surfaces of the wall panel to be made with said grid therebetween;

a plurality of C-shaped brackets, at least two spaced along the length of each of opposing segments of the two innermost rods of either said vertical or said horizontal members defining a space into which an insulation panel is to be inserted and having arms fixed to their respective rods and backs parallel to the edges of the insulation panel to be inserted therebetween; and a plurality of L-shaped brackets having backs fixed to said backs of their respective C-shaped brackets and arms extending inwardly with respect to their respective spaces, one fixed to each of said second plurality of C-shaped brackets, for supporting an insulation panel within its respective space between said vertical and horizontal members.

* * * * *